United States Patent [19]

Marcellis et al.

[11] 4,376,665

[45] Mar. 15, 1983

[54] EXPLOSIVE COMPOSITION COMPRISING PENTABORANE AND TRIS (DIFLUORAMINO) FLUOROMETHANE

[75] Inventors: Alphonso W. Marcellis, Boonton; Chester J. Grelecki, Denville, both of N.J.

[73] Assignee: The United States of America as represented by the Department of Energy, Washington, D.C.

[21] Appl. No.: 347,631

[22] Filed: Feb. 26, 1964

[51] Int. Cl.[2] ..... C06B 47/10

[52] U.S. Cl. ..... 149/22

[58] Field of Search ..... 149/22

[56] References Cited

U.S. PATENT DOCUMENTS 3,534,554 10/1970 Allan et al. ..... 149/22 X 3,857,742 12/1974 Bieber et al. ..... 149/22 X

*Primary Examiner*—Leland A. Sebastian

[57] ABSTRACT

1. A novel composition of matter comprising a mixture of pentaborane and tris (difluoroamino) fluoromethane.

4 Claims, No Drawings

EXPLOSIVE COMPOSITION COMPRISING PENTABORANE AND TRIS (DIFLUORAMINO) FLUOROMETHANE

The present invention relates to improved explosives and fuels. In particular it is related to a novel composition of matter and process for making same, which will provide an air sensitive fuel and explosive.

We have discovered a new high energy, high density explosive or monopropellant system consisting of an oxidizer containing nitrogen-fluoride bonds and a boron hydride reductant. Our novel composition of matter comprises a mixture of pentaborane and tris(difluoramino)fluoromethane. Mixtures of these compounds containing from about 99 weight percent to about 50 weight percent of tris(difluoroamino)difluoromethane based on the total weight of the mixture and from about one to about 50 weight percent of pentaborane based on the total weight of mixture have been found to be extremely useful as explosives. In the preferred embodiment of our invention we use a mixture containing about 90.2 weight percent of tris(difluoramino)fluoromethane based on the total weight of the mixture and about 9.8 weight percent of pentaborane based on the total weight of the mixture. Specifically, the system is a homogeneous solution consisting of a 3.4 to 1 molar ratio of tris(difluoramino)fluoromethane and pentaborane. This system is capable of producing the desirable combination products shown below in the balanced equation:

$$24FC(NF_2)_3+7B_5H_9\rightarrow 35BF_3+63HF+36N_2+24C$$

The energy available in this system makes it an excellent explosive as well as enabling it to be used as a liquid rocket fuel, or as an additive to liquid or solid rocket fuels to improve the performance of the latter.

Pentaborane is a liquid hydride having the empirical formula $B_5H_9$. It is prepared by the pyrolysis of diborane. It is a commercially available colorless liquid which has a molecular weight of 63.17, a melting point of 46.6° C., a boiling point of 60.0° C. and a density of 0.62 gr/ml at 25° C.

Tris(difluoramino)fluoromethane is a volatile liquid having the empirical formula $CN_3F_7$; $[FC(NF_2)_3]$. It is prepared by the fluorination of ammeline (4,6-diamino-s-triazin-2-ol; cyanurodiamide). It is a colorless liquid under pressure having a molecular weight of 137, a melting point of −135° C., a boiling point of 4° C., a density of 1.58 g/ml at 25° C. and a vapor pressure of 31 psia at 25° C.

A mixture containing 91 weight percent tris(difluoramino)fluoromethane and 9 weight percent pentaborane has a density of 1.42 g/ml at 25° C., a boiling point of 5° C. and a vapor pressure of 30 psia at 25° C.

While the ingredients of our novel compositions can be mixed in any order we have discovered that it is preferred to add pentaborane to the mixing vessel first and thereafter admixing the tris(difluoramino)fluoromethane to the pentaborane in the mixing vessel for the following reasons:

1. The density relationship between pentaborane (density=0.62 g/ml at 25° C.) and tris(difluoramino)fluoromethane (density=1.58 g/ml at 25° C.) is such that mixing by convection is facilitated if the pentaborane is added first.

2. Pentaborane is reactive with air and water. If the mixing chamber is inadvertently contaminated with traces of air or water these will react with pentaborane. If pentaborane is added to the system first, then this reaction will occur rather quietly and the tris(difluoramino)fluoromethane can be added without incident. If the tris(difluoramino)fluoromethane is added first it does not react with trace quantities of air and water which may be present in the mixing vessel. Subsequent addition of pentaborane to the tris(difluoramino)fluoromethane contaminated with air and water will result in a reaction between the pentaborane and air or water which could be sufficient to initate a severe explosion of the mixture.

The following example is given merely to illustrate the practice of our invention and should not be construed in any sense as a limitation of the scope thereof.

EXAMPLE

The explosive mixture was prepared in an evacuated 2½ inch Kel-F mixing tube having a ¼ inch diameter. 60 mg of pentaborane (0.952 mmoles) was measured in a constant volume apparatus of 0.278 liter capacity at 27° C. The pressure was 64 mm Hg. This was transferred to the mixing chamber via a glass vacuum line by condensation with liquid nitrogen at −196° C. Six hundred and twenty two (622 ) milligrams of tris(difluoramino)fluoromethane (3.32 mmoles) was measured in a constant volume apparatus of 0.282 liter capacity at 27° C. The pressure was 220 mm Hg. This was also transferred to the mixing chamber by condensation with liquid nitrogen at −196° via a glass vaccum line. The mixture was then allowed to warm to room temperature. The resulting mixture was a clear, colorless sensitive explosive.

The relative brisance of an explosive is tested in a modified Trauzl Block test. In this test, a lead rod 3 inches long and 2 inches in diameter is bored out so that the walls of the resulting cylinder are ½ inch thick. The volume of the cavity is measured. A known quantity of explosive in a glass tube is placed into the cavity. A No. 8 blasting cap is placed inside the cavity along side the explosive to be tested and ignited electrically. An indication of initiation and a qualitative estimate of the explosive power is obtained from the amount of deformation experienced by the lead cylinder. The deformation is reported in terms of the increased volume of the cylinder in units of $cm^3$ per gram of explosive.

A mixture containing 48 mg of pentaborane and 437 mg of tris(difluoramino)fluoromethane when tested in the Trauzl Block test gave an expansion of 31 $cm^3/g$. Under similar conditions TNT gave an expansion of 5 $cm^3/g$ and RDX gave an expansion of 30 $cm^3/g$.

The vacuum technique used to prepare the laboratory sample in the example shown above could be abandoned in favor of a pressure charging technique for the preparation of the novel compositions of matter disclosed in this invention.

Having described our invention what we claim as new and desired to secure by Letters Patent is:

1. A novel composition of matter comprising a mixture of pentaborane and tris(difluoramino)fluoromethane.

2. A novel composition of matter comprising a mixture containing from about 50 to about 99 weight percent of tris(difluoramino)fluoromethane based on the total weight of the mixture and from about one to about 50 weight percent of pentaborane based on the total weight of the mixture.

3. A novel composition of matter comprising a mixture containing about 90.2 weight percent of tris(difluoramino)fluoromethane based on the total weight of the mixture and about 9.8 weight percent of pentaborane based on the total weight of the mixture.

4. A process for preparing an air sensitive explosive composition of matter comprising adding tris(difluoramino)fluoromethane to pentaborane in an air and water free environment.

* * * * *